US005797465A

United States Patent [19]

Shibasaki et al.

[11] Patent Number: 5,797,465

[45] Date of Patent: Aug. 25, 1998

[54] MULTI-SHAFT DRILLING UNIT

[75] Inventors: Mitsuhiro Shibasaki; Hiroaki Kubo, both of Tokyo; Akira Mori, Kawasaki; Hachiro Hatakeda, Tokyo; Tsutao Takahashi, Yokohama; Tetsuo Nakamura, Soka, all of Japan

[73] Assignee: Chemical Grouting Company, Ltd., Tokyo, Japan

[21] Appl. No.: 335,693

[22] PCT Filed: Oct. 22, 1993

[86] PCT No.: PCT/JP93/01529

§ 371 Date: Nov. 15, 1994

§ 102(e) Date: Nov. 15, 1994

[87] PCT Pub. No.: WO95/11349

PCT Pub. Date: Apr. 27, 1995

[51] Int. Cl.[6] ..... E21B 7/00

[52] U.S. Cl. ..... 175/108; 175/162; 175/113; 175/220

[58] Field of Search ..... 175/108, 113, 175/91, 162, 85, 79, 220; 405/267, 269

[56] References Cited

U.S. PATENT DOCUMENTS 3,760,915 9/1973 Young et al. ..... 175/108 X 4,537,536 8/1985 Tsubonuma et al. ..... 405/240

FOREIGN PATENT DOCUMENTS 59-53999 12/1984 Japan .

2-115406 4/1990 Japan .

5-179649 7/1993 Japan .

*Primary Examiner*—Roger J. Schoeppel

*Attorney, Agent, or Firm*—Armstrong, Westerman, Hattori, McLeland & Naughton

[57] ABSTRACT

At least one guide shaft is equipped on one or both sides of a plurality of drilling shafts arranged on a line; and a jet nozzle is equipped with said guide shaft. A multi-shaft drilling unit, equipped with preferably three auger shafts, is used to develop a continuous wall under the ground. In such a unit, a housing for maintaining a pitch between the auger shafts includes a housing comprising: a primary gear rotating around the central auger shaft; a pair of secondary gears engaging with the primary gear; a primary bevel gear integral to the primary gear; a secondary bevel gear engaging with said primary bevel gear and fixed to a rotary shaft which rotary shaft is perpendicular to a straight line connecting the center lines of auger shafts; and cutters fixed at both ends of the rotary shaft.

2 Claims, 15 Drawing Sheets

MULTI-SHAFT DRILLING UNIT

BACKGROUND OF THE INVENTION

1. Field of the Invention

The present invention relates to a multi-shaft drilling unit used to develop a continuous wall under the ground.

2. Description of the Related

In an in-situ soil mixing method, subsoil is drilled in a wall-shape and a mixed liquid of cement, and the like, is discharged from an end point of an auger shaft to mix with the in-situ soil to develop a continuous wall and is applied to form cut-off walls in works on retaining walls and shoring in underground works of civil engineering construction and has been widely effectively used.

A multi-shaft auger machine for the development of such continuous wall is explained with reference to FIGS. 18 and 19.

In FIG. 18, a drive unit 103 is equipped to move vertically on a guide post 102 mounted on a crawler truck 101; a multi-shaft unit 104 is connected to the lower part of such drive unit 103; and a plurality of auger shafts (three shafts as shown in the illustrated example) 110A, 110B and 110C, hereinafter referred to collectively as "105" are installed on the multi-shaft unit 104.

A drilling cutter 106 is equipped at the lower end of each auger shaft 105; a screw type movable wing 107 of which the diameter is the same as the drilling cutter 106 and a bar-shaped auger wing 108 are alternately equipped at the upper part of the drilling cutter 106; and each end of the auger wing, next to the other one, is reciprocally working to form a continuous wall unit by mixing in-situ soil with mixed liquid to improve retention and cut-off power by molding H-type steel and sheet pile to the continuous wall, where required.

In the aforementioned conventional multi-shaft auger machine of the prior art, because outer auger shafts 110A, 11OC and a center auger shaft 11OB alternately rotate in the opposing directions respectively to complete the mixture, the rotary reaction force of the drilling cutters 106 is apt to be unbalanced as much as 2:1, and the linearity of such continuous wall unit deteriorates.

In addition, the pitch between auger shafts 105 is limited such as to be required to continue drilled holes by overlapping each rotary range of the drilling cutters 106.

Furthermore, H-type steel is required to be fabricated for each shaft line of the auger shafts.

Still further, in such multi-shaft auger machine shown in FIGS. 18 and 19, a triangular irregularity overlapped by outer rotation loci of the drilling cutters is formed at both longitudinal sides of the continuous wall unit obtained by operating auger shafts. This is an undesirable feature of attainable strength.

There has been disclosed a multi-shaft auger machine, in which the linearity is remarkably good and such that a continuous wall can be developed without any limitation on a position where H-type steel is molded and the pitch between auger shafts is long in Japanese Patent Application Disclosure No. 2-115406. Because chain drive drilling cutters are provided angularly close to the lower ends of the auger shafts of this multi-shaft auger machine which is equipped with a plurality of auger shafts used to develop a continuous wall under the ground, any irregularity can be removed by such chain drive drilling cutters even if any triangular irregularity is formed by overlapping outer rotation loci of such drilling cutters.

According to the prior art disclosed in Japanese Patent Application Disclosure No. 2-115406, however, there is a problem with the linearity of a continuous wall because such machine is not constructed to completely withstand a reaction force, even the rotary reaction force in one direction. Besides, there is the problem of reliability because chains are apt to loosen and breakage or damage may occur.

The object of the present invention is to provide a highly reliable multi-shaft drilling unit to develop a continuous wall of which the linearity is remarkable in consideration of the aforementioned problems involving the prior art.

SUMMARY OF THE INVENTION

The multi-shaft auger machine in the present invention is equipped with a guide shaft on one side on a line of the drilling unit providing a plurality of drilling shafts of which the shaft center is arranged in a line. According to the embodiment of the present invention, guide shafts are desirably equipped on both sides of the drilling unit providing a plurality of drilling shafts of which the shaft center is arranged in a line.

Furthermore, a jet nozzle is preferred provided on the guide shaft.

In addition, a housing, equipped with such multi-shaft drilling unit providing three auger shafts used to develop a continuous wall under the ground is provided in the present invention and desirably comprises: a primary gear rotating around the central auger shaft; a pair of secondary gears engaging the primary gear; a primary bevel gear integral with the primary gear; a secondary bevel gear engaging the primary bevel gear and fixed to a rotary shaft orthogonally crossing a line connecting the auger shafts; and a cutter fixed to the ends of the rotary shafts.

According to the multi-shaft drilling unit constructed as mentioned above, a guide hole is drilled firstly, and then the guide hole guides a guide shaft to drill a hole with the drilling shaft. Therefore, a plurality of continuous holes can be drilled with good linearity because the guide shaft receives a reaction force. Additionally, because a hole at the end of the primary drilling hole, of which the drilling is completed, is applied as a guide hole, continuity to the secondary drilling hole can be maintained.

Furthermore, if the unit is constructed such that a jet stream is injected from a jet nozzle, a cross section of subsoil will be drilled in a wedge-shape as well as a drilling wing will be desirably washed.

In addition, if the unit is constructed with a housing having a space remaining between auger shafts comprising: a primary gear rotating around the central auger shaft; a pair of secondary gears engaging the primary gear; a primary bevel gear integral with the primary gear; a secondary bevel gear engaging the primary bevel gear and fixed to a rotary shaft orthogonally crossing a line connecting the auger shafts; and a cutter fixed to both ends of the rotary shaft, because the cutter cuts off a triangular convex that has remained in the prior art, a continuous wall unit of which both ends form a semicircle and both sides form a straight line on the subsoil can be formed.

DESCRIPTION OF THE PREFERRED EMBODIMENT

The preferred embodiment of the present invention is described below with reference to the referring to attached drawings, FIG. 1 to FIG. 17. The same numerals are marked in some parts in FIG. 18 and FIG. 19 and correspond to the same parts shown in these drawings, however, a detailed explanation is not given to avoid repetition.

Figure 1:
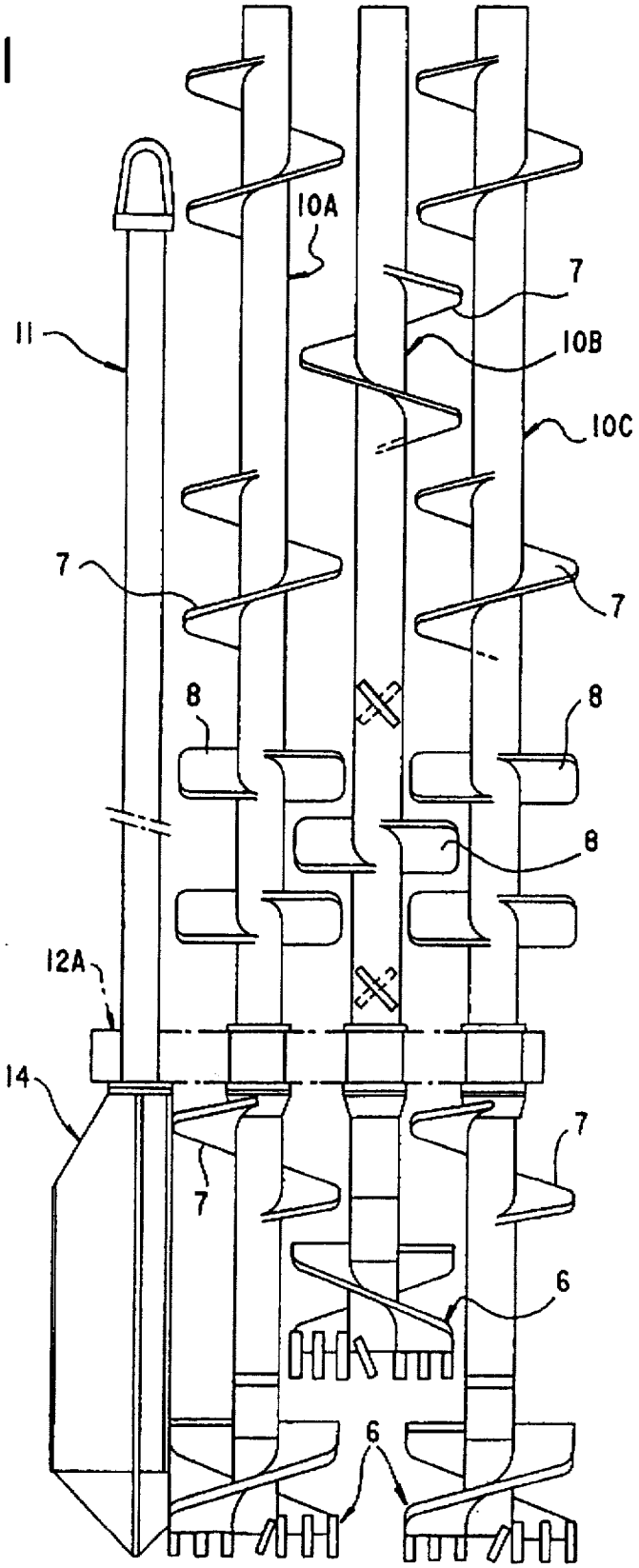
FIG. 1 is a front view showing an embodiment in the present invention.
Figure 2:
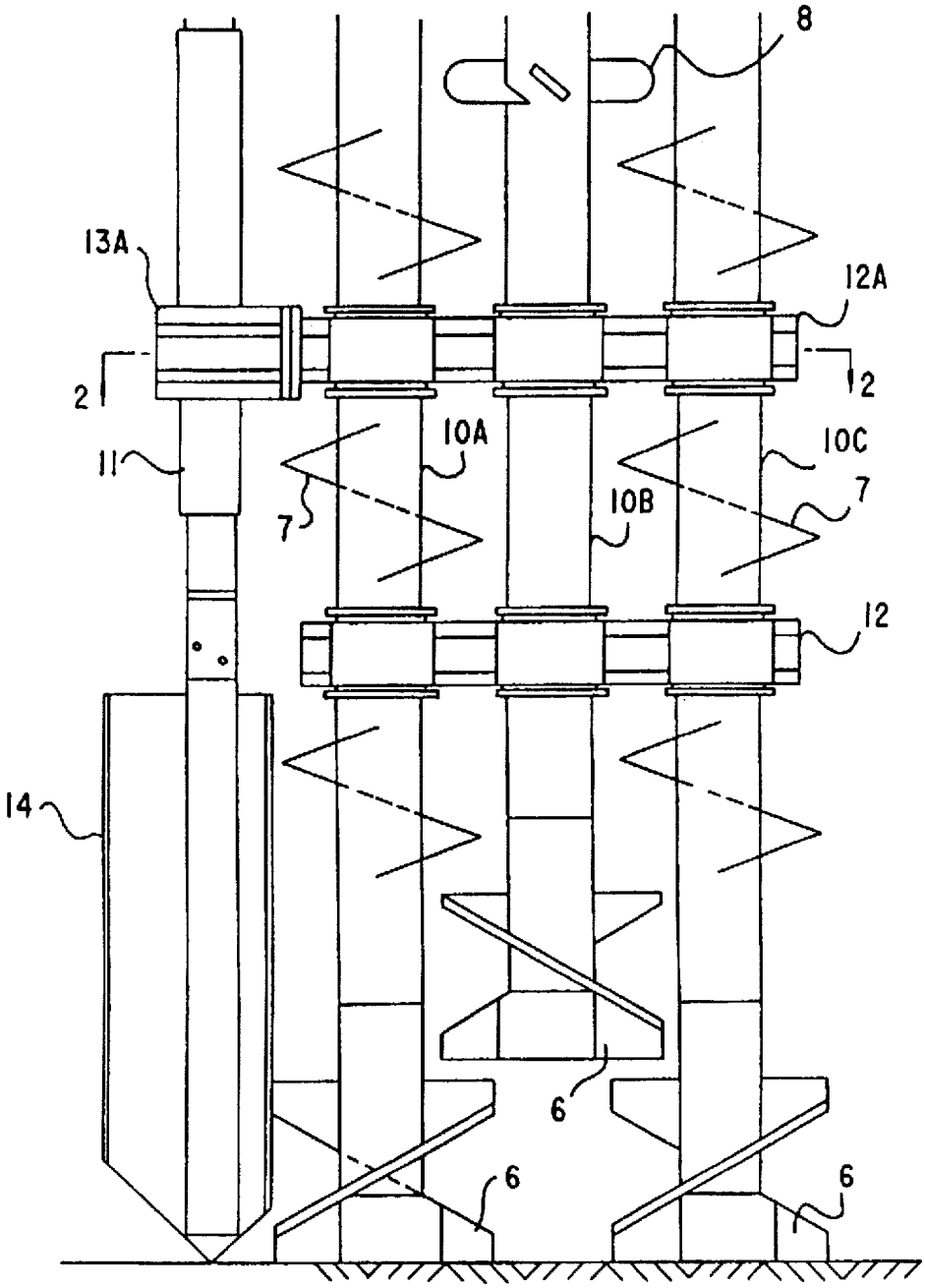
FIG. 2 is a drawing showing the lower part of FIG. 1.
Figure 3:
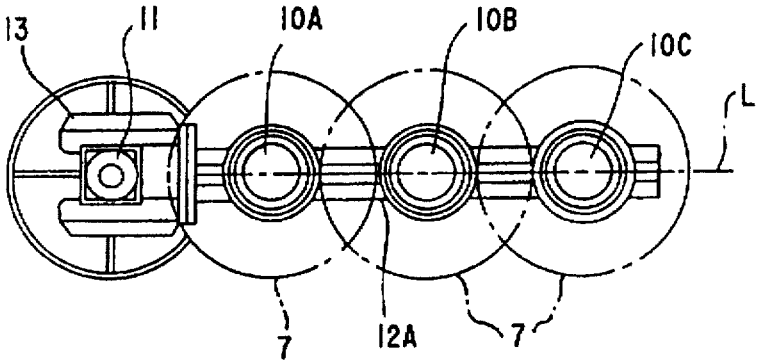
FIG. 3 is a section view showing an A—A line in FIG. 2.

In FIG. 1 or FIG. 3, a plurality of movable drilling shafts (three shafts in the illustrated drawing) 5A, 5B and 5C (hereinafter referred to collectively as "5" and an immovable guide shaft 11 are arranged such that the shaft centers are pitched on a straight line L. The drilling shafts 5A, 5B and 5C are mutually connected by interference prevention brackets 12, FIG. 3, serving as a plurality of bearings; and clamp brackets 13A that lock a guide shaft 11 are selectively connected to several brackets 12A of such brackets 12.

Figure 4:
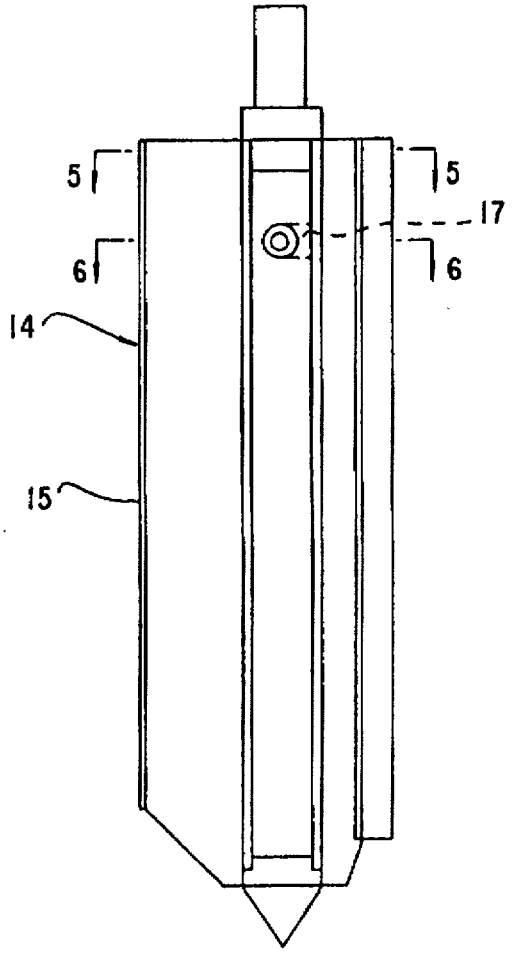
FIG. 4 is a front view showing a guide bit.
Figure 5:
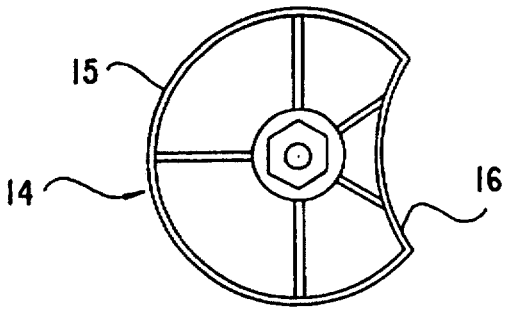
Fig.5 PRIOR ART
FIG. 5 is a section view showing a B—B line in FIG. 4.
Figure 6:
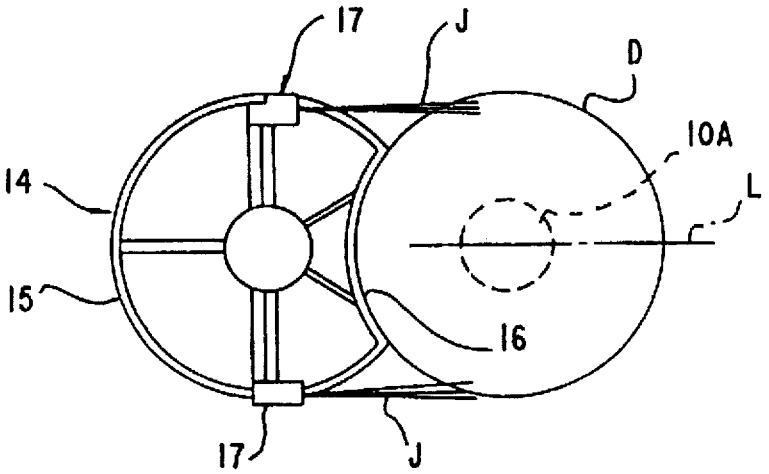
FIG. 6 is a section view showing a C—C line in FIG. 4.
Figure 7:
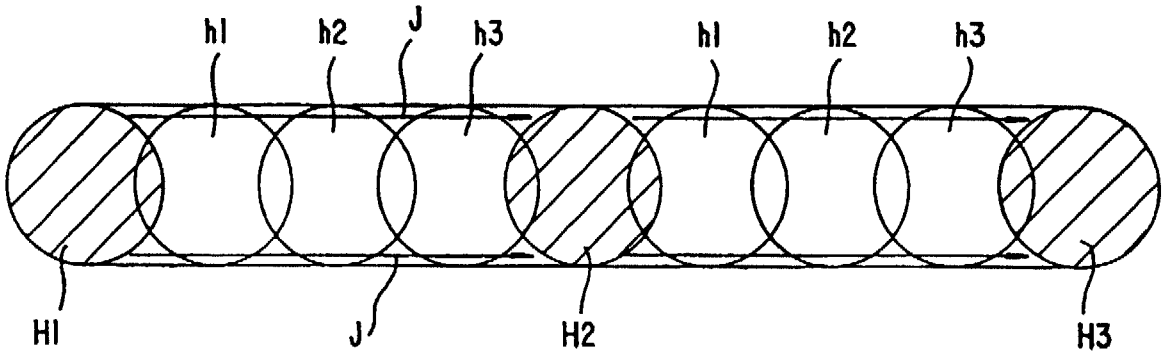
FIG. 7 is a plan view explaining the state of drilling.

Referring to FIG. 4 or FIG. 6, a guide bit 14 is provided at the lower end of the guide shaft 11. The body 15 of the guide bit is tubulate; the part overlapping with a drilling cutter 6, FIG. 6, of a drilling shaft 5A and with an outer rotation locus D of a movable wing 7 [both these and an outer diameter <R> of auger wing <8> are equally formed] is formed on a circular concave 16; and a pair of jet nozzles 117, FIG. 12, which inject a jet stream (J) in a tangential direction, are equipped on the outer circumference of the body 115 parallel to the line (L), FIG. 9.

Figure 8:
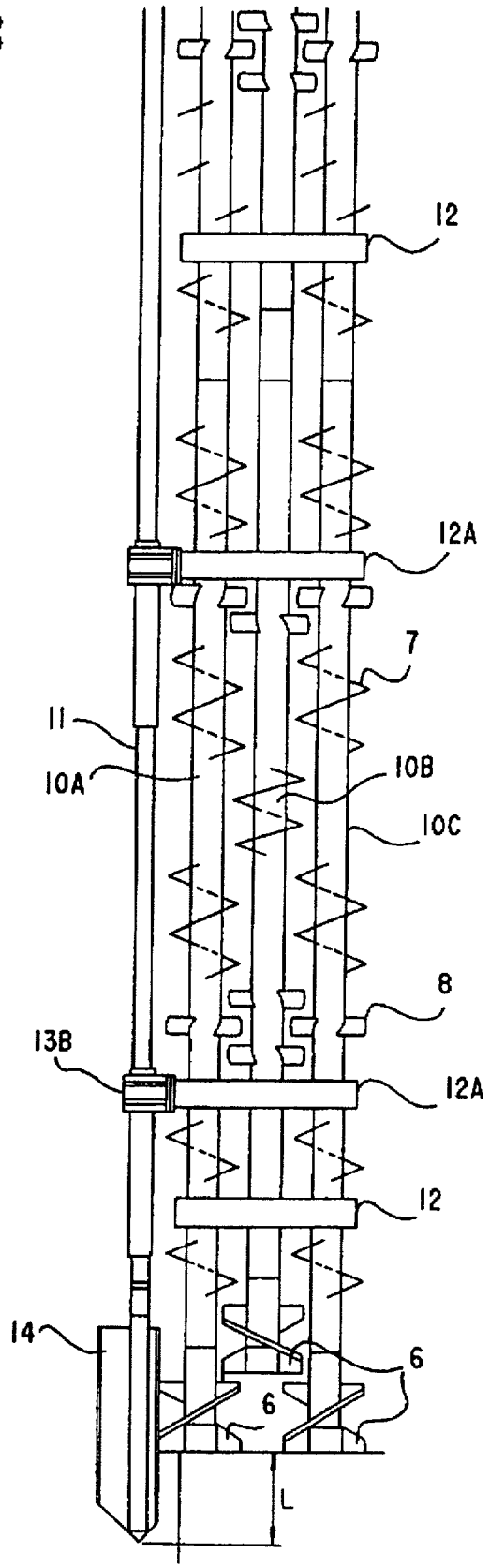
FIG. 8 is a front view explaining the state of drilling.
Figure 9:
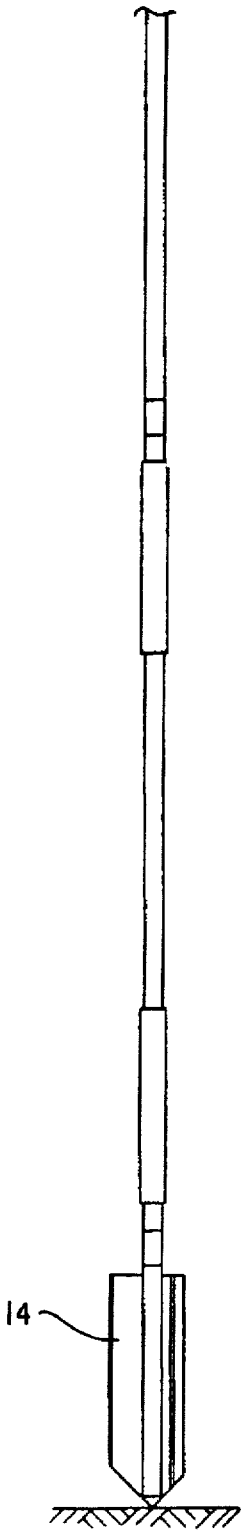
FIG. 9 is a front view explaining the other state of guide bit position.
Figure 10:
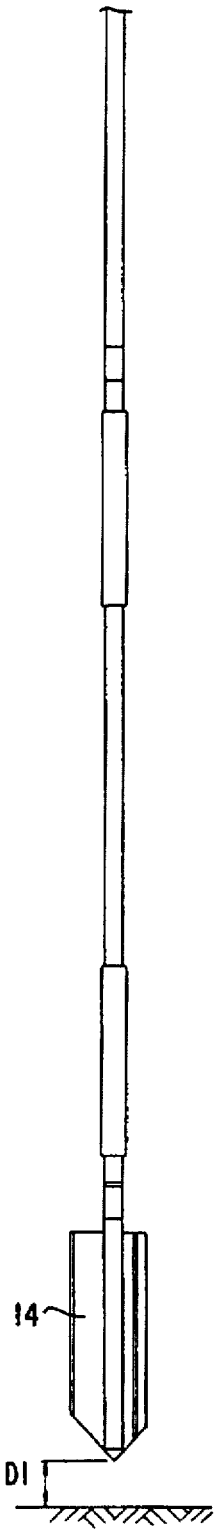
FIG. 10 is a front view explaining the other state of guide bit position.
Figure 13:
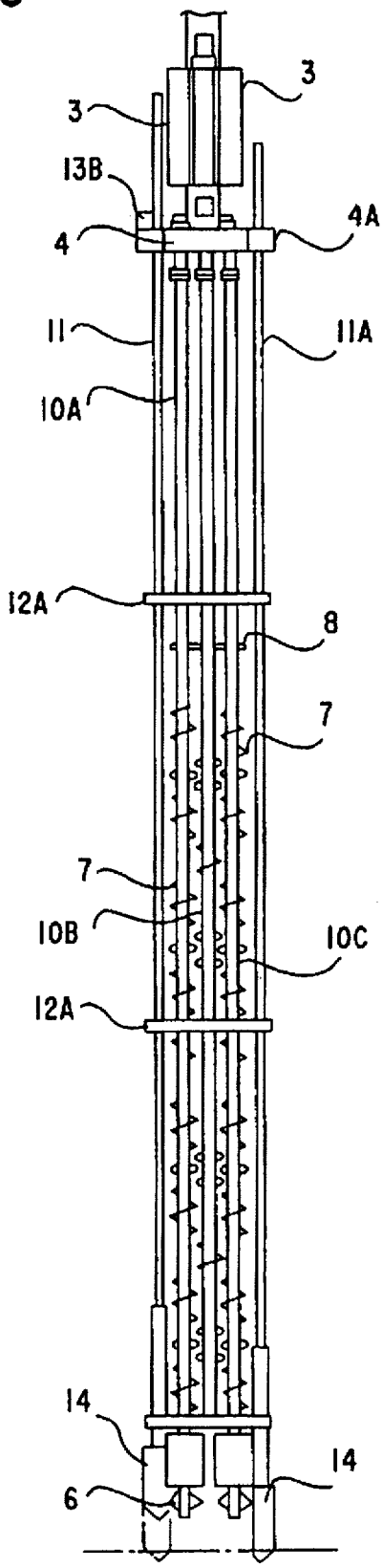
FIG. 13 is a front view of FIG. 12.

The following describe the state of drilling: As shown in FIG. 13; guide holes (Hi, H2, etc.) are drilled in advance. As shown in FIG. 8, a guide bit 114 is inserted in the guide hole Hi, FIG. 13, at first and holes (hi, h2 and h3) are drilled by drilling shafts 110A, 110B and 110C, FIG. 8, to drill the subsoil in a wedge-shape by a jet stream (J); doing the same operation in the guide hole (H2), i.e. holes (hi, h2 and h3) are drilled to drill the subsoil continuously in a wedge-shape with the jet stream (J); in this case, because guide holes (Hi, H2, etc.) receive drilling reaction force of the drilling shaft 10 through the guide bit 114, the linearity of the wedge shaped section is remarkable.

Figure 14:
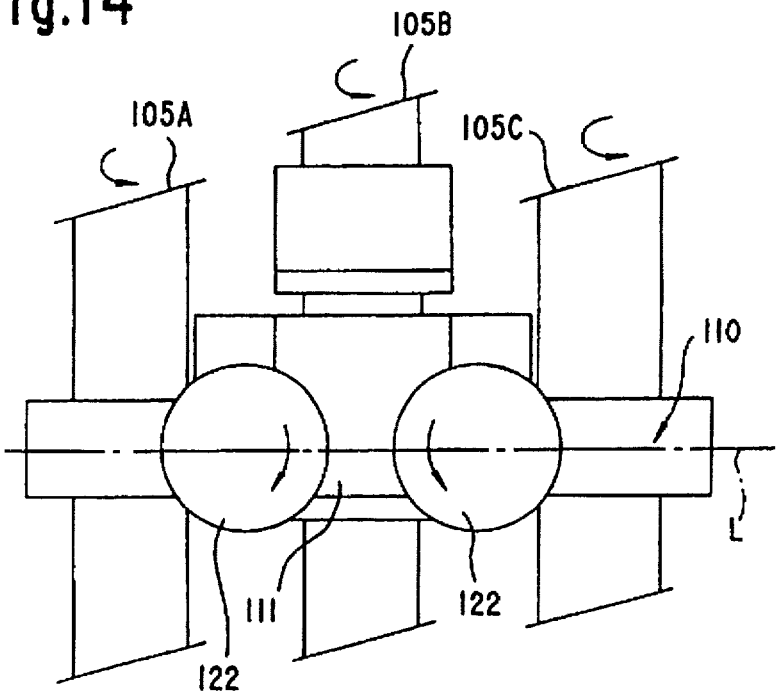
FIG. 14 is a schematic front view showing a pivotal part of an embodiment in the present invention.

In addition, as shown in FIG. 8, the holes are drilled such that the guide bit 114 lowers further than the drilling cutter 106 only by the length L (e.g. 500 mm–700 mm) of the drilling shaft 106, FIG. 14. In this case, guiding by the guide bit 114 is good, however, in some operations a clamp of the guide shaft 111 can be released by a clamp block 113 and a guide bit 114 can become free before the length L showing a scheduled drilling depth is required.

Figure 16:
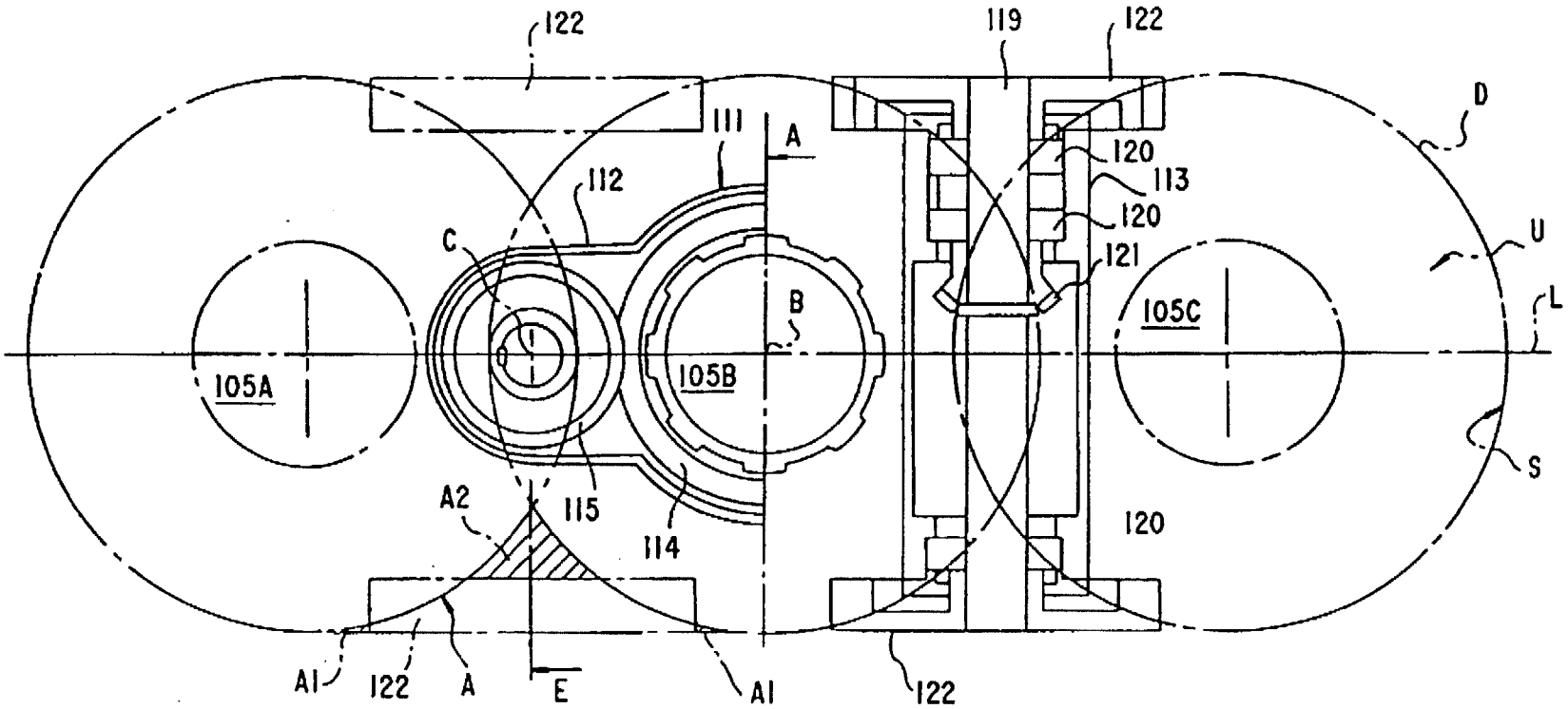
FIG. 16 is a horizontal section view showing details.

On the contrary, as shown in FIG. 8, when drilling is done at the same level of the guide bit 114 and drilling cutter 106 on the subsoil, or as shown in FIG. 14, when drilling is done in such a way that the guide bit 114 is pulled up by the length D1, FIG. 16, (e.g. 300 mm to 550 mm) more than the drilling cutter 106, release of the clamp on the guide bit 114 will not be required as mentioned above, however, since the guiding ability slightly decreases, it is desirable on weak ground.

Figure 11:
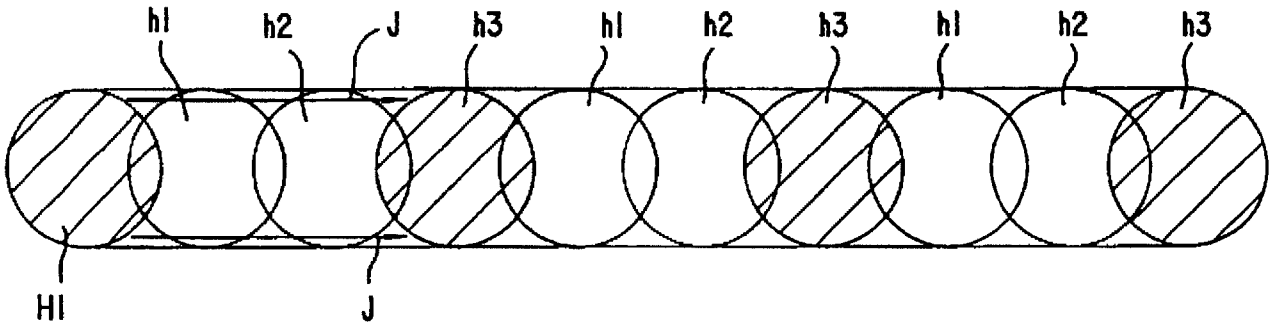
FIG. 11 is a plan view explaining the other state of drilling.

FIG. 11 shows another embodiment of drilling. When the first drilling on a guide hole Hl is completed, the second drilling will be executed as such a hole h3 is a guide hole. In this case, linearity is further desirable and the need for a jet stream (J) can be decreased in comparison with the aforementioned embodiment.

Figure 12:
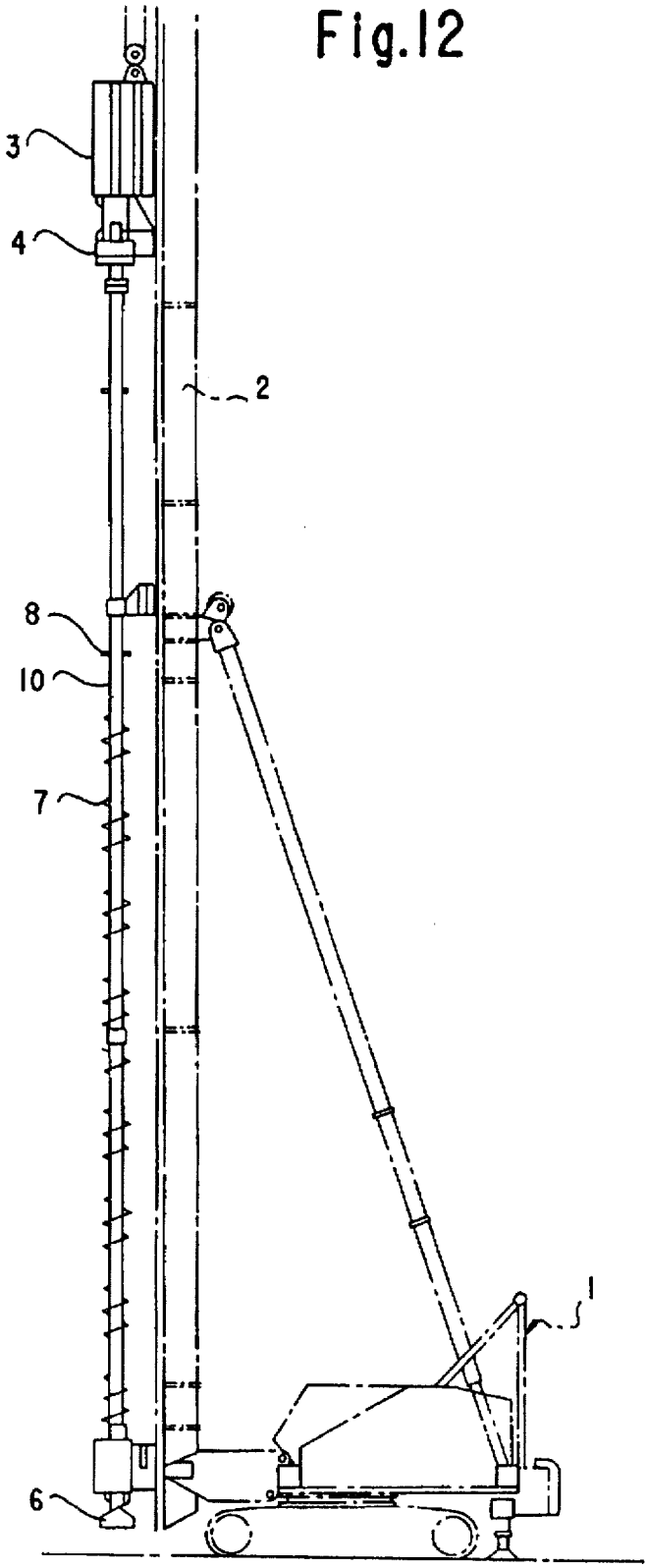
FIG. 12 is a side view showing the other embodiment in the present invention.

FIG. 12 and FIG. 13 show other embodiments of the present invention exemplifying that guide-shaft 111 is separately equipped on the sides of each drilling shaft 110A, 110B and 110C. According to this embodiment, as shown in FIG. 13, guide holes (Hl, H2) are used and the jet stream (J) is oppositely injected from such holes to do drilling so that linearity can be further improved.

Figure 15:
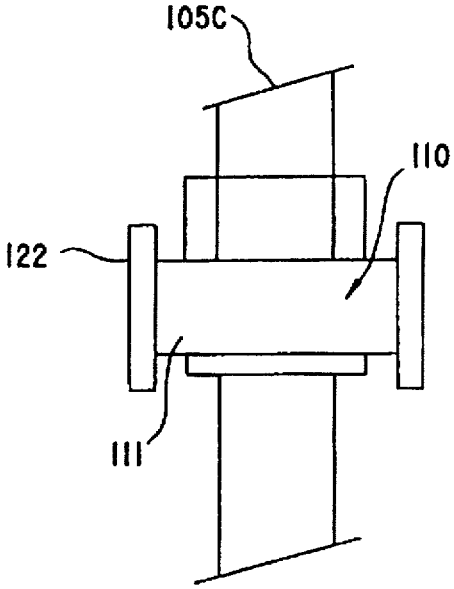
FIG. 15 is a side view of FIG. 14.

Furthermore, FIG. 14 to FIG. 17 show still other embodiments of the present invention. In FIG. 14 and FIG. 15, a pitch between the auger shafts 110A, 110B and 110C is retained by the housing 111 of a cutter drive unit 110 which serves as a bearing; and two pairs of cutters are provided on the unit 110 in parallel to a straight line (L) connecting the shaft centers of the drilling shafts 105.

Figure 17:
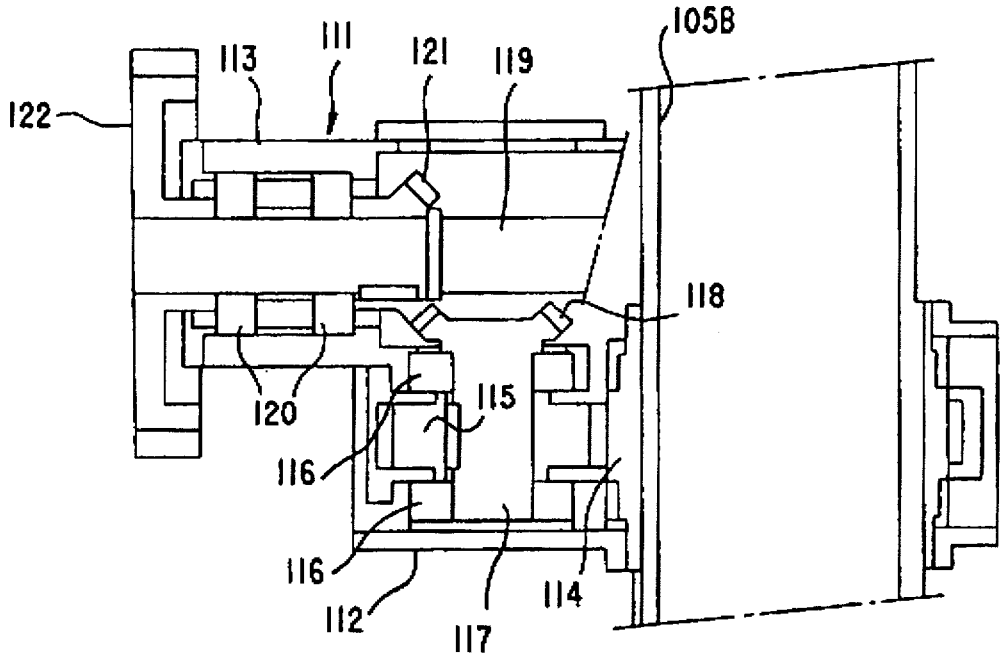
FIG. 17 is a section view showing an A-B-C-E line of FIG. 16.
Figure 18:
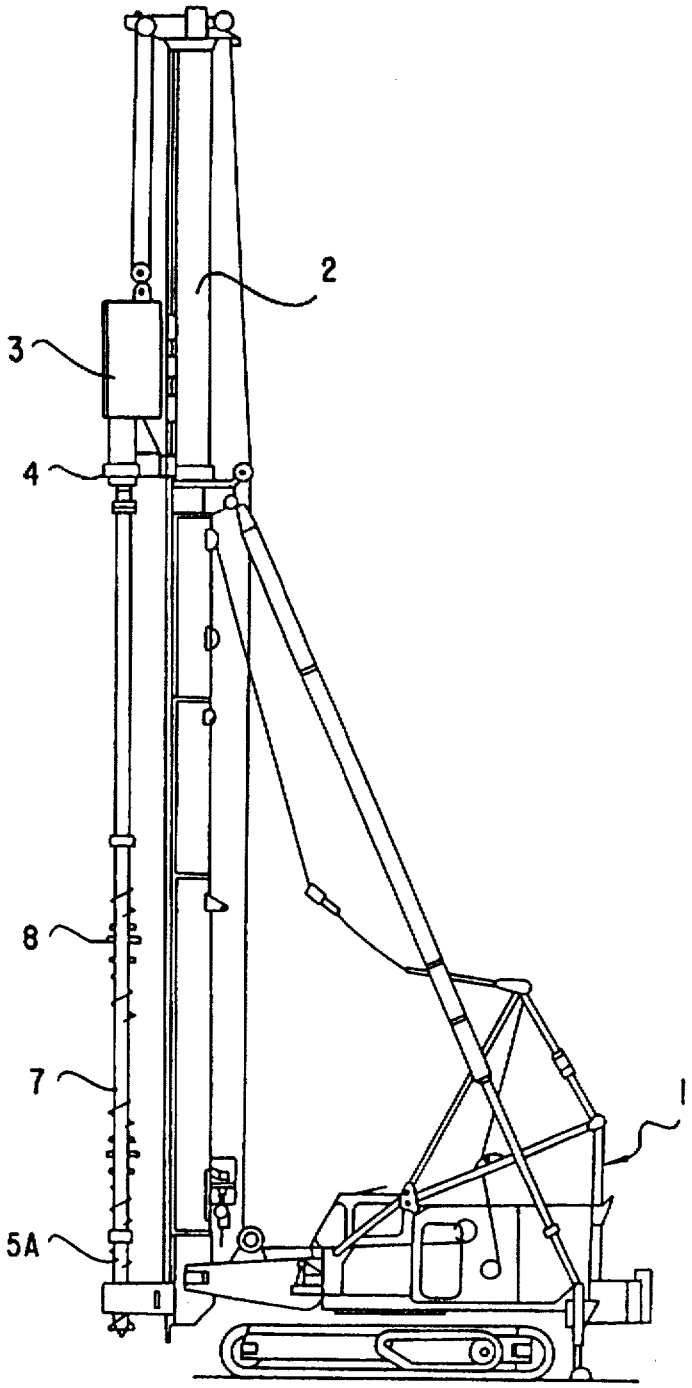
Fig.18 PRIOR ART
FIG. 18 is a side view showing a conventional auger machine in the prior art.

In FIG. 16 and FIG. 17, a housing 111 of the cutter drive unit 110 is formed in an H-shape by a primary part 112 including a straight line (L) and a secondary part 113 which orthogonally crosses a straight line (L) at the central part of each shaft 105.

The primary gear 114 is connected to the auger shaft 105B in serration; the primary gear 114 is engaged with a pair of secondary gears 115 which are arranged on the straight line (L) in the primary part 112; the secondary gears 115 are connected by a key to a shaft 117 which is vertically placed in the primary part 112 through a pair of bearings 116; the primary bevel gear 118 projecting into the secondary part 113 is fixed on the upper part of the shaft 117.

On the other hand, a rotary shaft 119 is placed in the secondary part 113 through three pairs of bearings 120; the secondary bevel gear 121 engaging with the primary bevel gear 118 is connected by a key on the side of two pairs of bearings 120 of rotary shaft 119; a cutter 122 is fixed on both sides of the rotary shaft 119.

Figure 19:
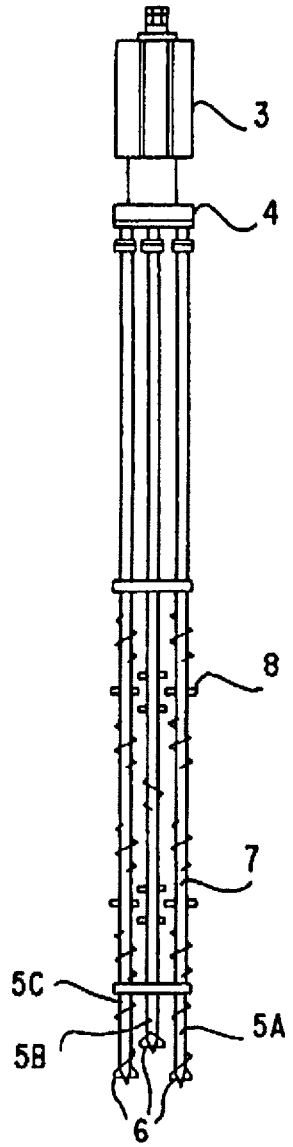
Fig.19 PRIOR ART
FIG. 19 is a front view showing an auger shaft of FIG. 18.

The cutter 122 is formed in such a way as to cut an outer triangular convex (A) generated on both sides of the straight line (L) by the outer rotation loci (D) of the drilling cutters 6, FIG. 19, which overlap alternately.

Therefore, when the auger shafts 110A, 110B and 110C rotate in the head direction of the arrow during drilling, a pair of cutters 122, 122, FIG. 14, will rotate in the opposite direction, as shown by an arrow, to cut the outer part (A) through the primary gear 114, secondary gear 115, primary bevel gear 118 and secondary bevel gear 121. As a result, a range of subsoil (S) of which both ends form a semicircle and both sides form a straight line is drilled by three outer rotation loci (D) and the outer surfaces of four cutters 122 to form a continuous-wall unit (U). In this case, because such cutters 122, 122 rotate in the opposite direction, the rotary reaction force is relieved and good balance is achieved. In addition, parts Al and A2 are not cut in FIG. 16, however, the part Al is so small as to be negligible and part A2 is naturally cut off, therefore, there is no problem.

Furthermore, a standard pitch between auger shafts 105A, 105B and 105C is shown in FIG. 16. However, a longer cut, longer than standard, can be applied in the other embodiment to drill residual soil by changing the measurement of cutters; and longer holes in a longitudinal direction are drilled.

What is claimed is:

1. A multi-shaft drilling unit comprising:

a plurality of drilling shafts used to develop a continuous wall under the ground, center lines of said drilling shafts being arranged in a single line and;

a guide shaft provided on one side of said single line, said unit including a housing for maintaining a pitch between said drilling shafts;

said housing comprising:

a primary gear rotating around a central drilling shaft of said plurality of drilling shafts;

a pair of secondary gears engaging with said primary gear;

a primary bevel gear integral to said primary gear;

a secondary bevel gear engaging with said primary bevel gear and being fixed to a rotary shaft which rotary shaft is perpendicular to a straight line connecting respective center lines of said drilling shafts; and cutters fixed at opposite ends of said rotary shaft for making a continuous groove for developing a continuous wall, a horizontal section of which groove is a rectangular shape.

2. A multi-shaft drilling unit comprising:

a plurality of drilling shafts used to develop a continuous wall under the ground, center lines of which shafts are arranged in a single line; and at least one guide shaft provided on at least one side of said single line, said unit including a housing for maintaining a pitch between said drilling shafts, said housing comprising:

a primary gear rotating around a central drilling shaft of said plurality of drilling shafts;

a pair of secondary gears engaging with said primary gear;

a primary bevel gear integral to said primary gear;

a secondary bevel gear engaging with said primary bevel gear and being fixed to a rotary shaft which rotary shaft is perpendicular to a straight line connecting center lines of said plurality of said drilling shafts; and cutters fixed at opposite ends of said rotary shaft for making a continuous groove for developing a continuous wall, a horizontal section of which groove having a rectangular shape.

* * * * *